United States Patent [19]

Kelly

[11] 4,216,590

[45] Aug. 12, 1980

[54] WIDE ANGLE INCLINOMETER

[75] Inventor: Robert R. Kelly, Hoffman Estates, Ill.

[73] Assignee: BJ-Hughes Inc., Long Beach, Calif.

[21] Appl. No.: 27,771

[22] Filed: Apr. 6, 1979

Related U.S. Application Data

[63] Continuation of Ser. No. 844,398, Oct. 21, 1977, abandoned.

[51] Int. Cl.[3] ..... E21B 47/022; G01C 9/00

[52] U.S. Cl. ..... 33/304; 33/307

[58] Field of Search ..... 33/304, 306, 307, 312, 33/391, 399, 398

[56] References Cited

U.S. PATENT DOCUMENTS

| | | | |
|---|---|---|---|
| 2,329,732 | 9/1943 | Varney et al. | 33/306 |
| 2,435,934 | 2/1948 | Varney et al. | 33/306 |
| 2,762,132 | 9/1956 | Varney | 33/307 |
| 2,824,380 | 2/1958 | Nelson | 33/307 |
| 3,176,407 | 4/1965 | Alder et al. | 33/306 |
| 3,431,654 | 3/1969 | Alder | 33/306 |
| 3,466,755 | 9/1969 | Alder | 33/306 |
| 3,555,691 | 1/1971 | Jacoby | 33/312 |
| 3,571,936 | 3/1971 | Taylor | 33/306 |

OTHER PUBLICATIONS

*The Teledrift Inclinometer,* Paper Submitted to Society of Petroleum Engineers, Oct. 24, 1963.

*Primary Examiner*—Steven L. Stephan
*Attorney, Agent, or Firm*—Jonathan E. Jobe, Jr.

[57] ABSTRACT

Improved apparatus for measuring the angular deviation from the vertical of the end of the drill string which includes a housing adapted for insertion in the drill string, a pendulum pivotally mounted in the housing and capable of swinging through large angles, and a substantially perfectly balanced catch link pivoted at the same point as the pendulum and normally coaxially aligned with the end of the drill string. Means are provided for coupling the pendulum and catch link together at a preselected angle and for measuring the deflection of the coupled pendulum and catch link from the axis of the end of the drill string so that the angular deviation from the vertical of the end of the drill string may be determined. Means are provided for signalling the measure of the deflection to the surface.

14 Claims, 8 Drawing Figures

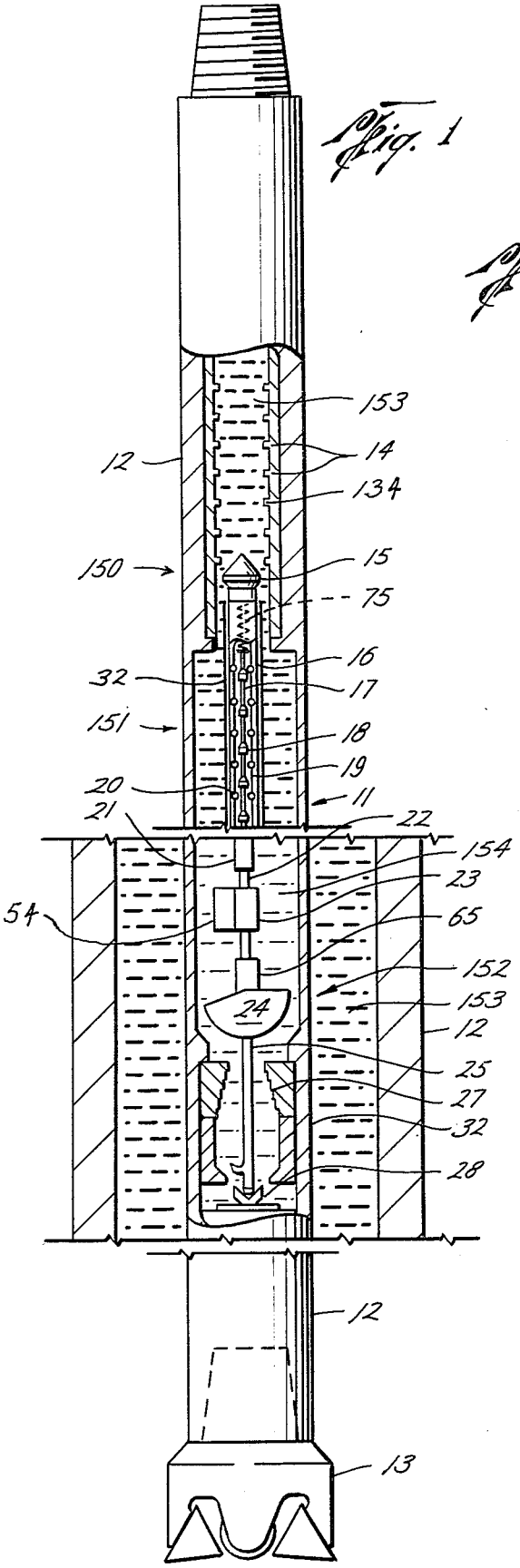
Fig. 1
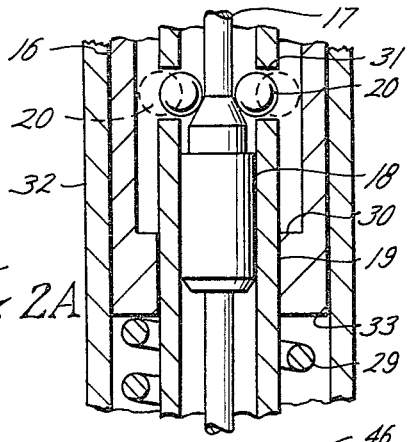
Fig. 2A
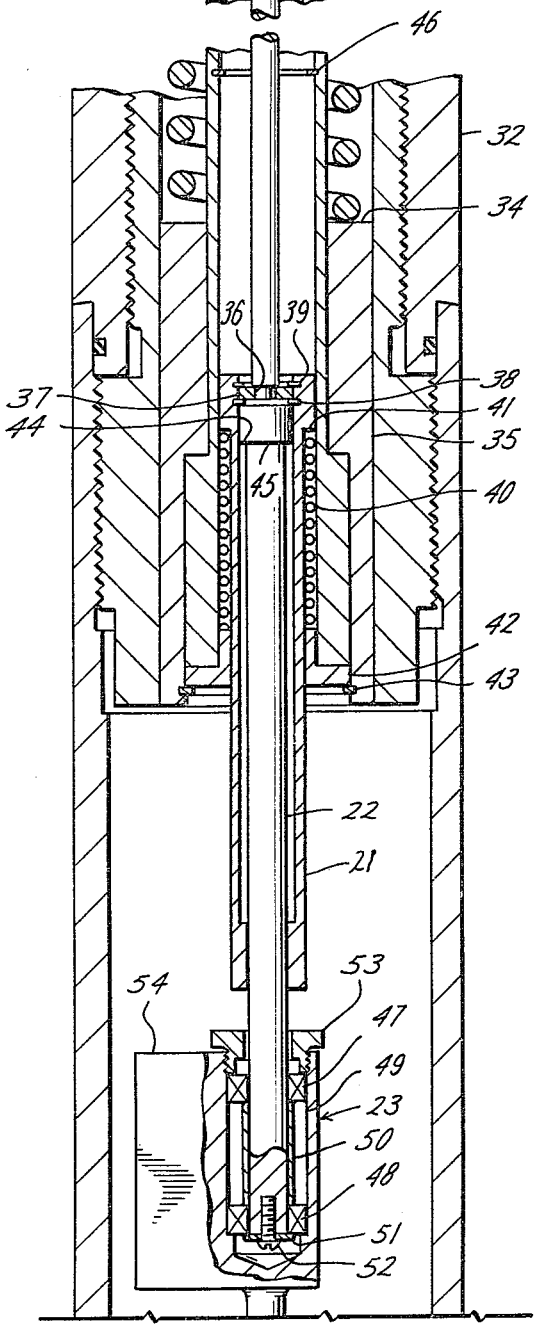

WIDE ANGLE INCLINOMETER

This is a continuation of application Ser. No. 844,398, filed Oct. 21, 1977, now abandoned.

BACKGROUND OF THE INVENTION (a) Field of the Invention

This invention relates to apparatus for measuring the angular deviation of the end of a drill string, and more particularly to apparatus of the mud pressure pulse signalling type.

(b) Description of the Prior Art

Patents and publications showing the general state of the prior art include: U.S. Pat. Nos. 2,329,732; 2,435,934; 2,762,132; 2,824,380; 3,431,654 and Society of Petroleum Engineers of AIME Paper Number SPE 765. The most pertinent prior art patents are U.S. Pat. Nos. 3,176,407 and 3,466,755, which teach apparatus which includes a pendulum within a housing placed in the drill string. The pendulum is suspended from a rod that is axially movable in the housing downwardly in response to mud pressure and upwardly in response to the cessation of mud flow. The upward movement of the rod is limited by a set of concentric stop rings of decreasing ascending diameter adapted to engage the pendulum, dependent upon the deviation of the pendulum from the axis of the string. A coding system is provided whereby relatively short movements of the pendulum and rod are translated into relatively long movements of a knob headed shaft extending radially outwardly from the housing. In addition to magnifying the length of movement of the pendulum and rod, the coding system inverts the movement whereby a minimum movement of the pendulum and rod gives rise to a maximum movement of the shaft and a maximum movement of the pendulum and rod gives rise to a minimum movement of the shaft. The inversion causes the shaft movement to be directly proportional to the deviation measured. The measure of the deviation is signaled to the surface by pressure pulses created by means of the interaction of the knob with a plurality of pulse rings in the string above the housing. The number of pulses detected at the surface is directly proportional to the angular deviation of the string. With pressure pulse signalling type deviation measuring devices, deviation may be measured each time a length of pipe is added to the string, and thereby allow substantially continuous monitoring of deviation.

Because of length and diameter constraints, the devices of the prior art are limited to measuring angles in a range from 0 to approximately 10 degrees. However, in directional drilling programs it is necessary to measure accurately angles much in excess of 10 degrees. Presently, such large angles are measured by various multi-shot survey instruments. However, the use of such instruments is costly in that considerable valuable rig time is expended in running such instruments into the hole. Additionally, multi-shot surveys are not well suited for substantially continuous monitoring of hole deviation, as would be desirable in directional drilling programs, and as is possible with deviation measuring apparatus of the pressure pulse signalling type.

SUMMARY OF THE INVENTION

It is therefore an object of the invention to provide a deviation measuring apparatus of the pressure pulse signalling type that is capable of measuring large angles.

Briefly stated, in the apparatus of the present invention, the pendulum of the prior art is replaced by a pendulum capable of freely swinging through large angles, a balanced catch link normally coaxially aligned with the end of the drilling string when mud is being pumped through the string, and means for coupling the pendulum and catch link together at a preselected known angle and deflecting the pendulum some relatively small but unknown angle from the vertical. The unknown angle is equal to the difference between the preselected angle at which the pendulum and catch link are now coupled together and the deviation from the vertical of the drill string. When the flow of mud through the string is interrupted, the pendulum and catch link move upwardly along the drill string axis until the catch link is free from being restrained coaxially with the drill string. When the coaxial restraint is removed, the pendulum returns to the free-swing position thereby deflecting the catch link away from the axis of the string by the same angle as the pendulum was collected when the catch link was restrained. The deflection of the catch link is then measured in the same way that the prior art devices measured the deflection of the prior art pendulum and the measure of that deflection is signaled to the surface in the conventional manner thereby enabling the driller to determine the deviation from the vertical of the drill string.

BRIEF DESCRIPTION OF THE DRAWINGS

FIG. 1 is sectional view (with a portion enlarged) of the apparatus of the preferred embodiment showing the major components thereof in its intended environment.

FIG. 2A is a sectional view showing the upper portion of the apparatus of the preferred embodiment.

DESCRIPTION OF THE PREFERRED EMBODIMENT

Figure 2B:
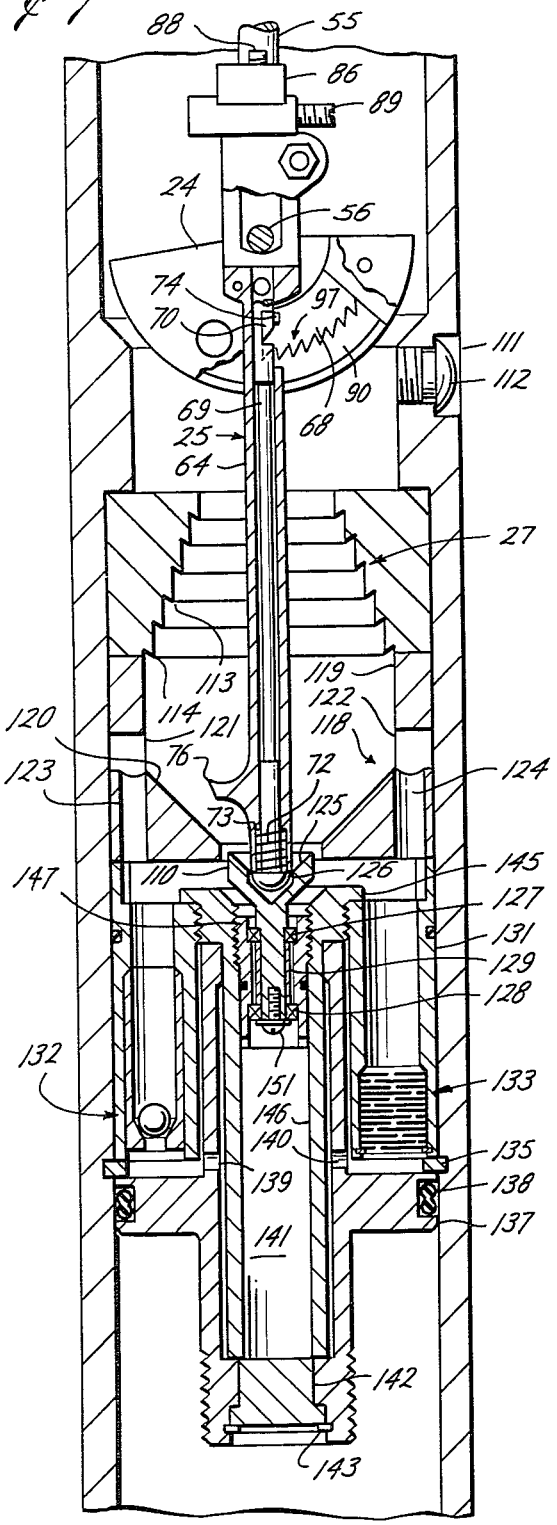
FIG. 2B is a continuation of FIG. 2A showing the lower portion of the preferred embodiment.

Referring now to FIG. 1, the apparatus of the preferred embodiment is designated generally by the numeral 11. Apparatus 11 is contained within a tubular sub 12 adapted for coaxial insertion in a drill string above the bit 13. Apparatus 11 is comprised generally of means 150 for forming pressure pulses to signal to the surface the measure of the deviation of sub 12, means 151 for coding angular deviation into pressure pulses, and means 152 for measuring the angular deviation of sub 12.

As with prior art devices, pulse forming means 150 includes a plurality of pulse rings 14, and a shaft 16 having a knob 15 on the end thereof. Shaft 16 is biased upwardly by the force of a main spring 29, as illustrated in FIG. 2A, against the downward flow of mud 153 through sub 12. When the flow of mud 153 through sub 12 is interrupted, shaft 16 drives knob 15 upwardly to a position adjacent one pulse ring 14, the position being determined by the angular deviation of sub 12, as will be described hereinafter. When the flow of mud 153 is resumed, knob 15 is forced downwardly and a series of pressure pulses are created as knob 15 passes each pulse ring 14, which pressure pulses may be read at the surface by the driller and converted into angular deviation, as is well known in the art.

Coding means 151 is taught in the prior art and includes a plurality of thimbles 18, a coding tube 19, a plurality of coding balls 20, and a shoulder 30 at the lower end of shaft 16, illustrated in FIG. 2A. Coding tube 19 has therein a plurality of holes 31, illustrated in FIG. 2A, containing coding balls 20. Holes 31 are spaced apart distances which correspond to the spacing of pulse rings 14. Telescopically disposed within coding tube 19 is coding rod 17. Coding rod 17 is axially movable within coding tube 19 upwardly when the flow of mud 153 is interrupted by means of a pendulum lift spring 40, illustrated in FIG. 2A, and downwardly by the force of the mud 153 on knob 15. The force of the mud 153 on knob 15 is transmitted to coding rod 17 by a seating spring 75 disposed in a chamber at the upper rod of shaft 16. Coding rod 17 has a plurality of radially enlarged thimbles 18 thereon, which thimbles are spaced apart to be adjacent to a particular set of coding balls 20 when the catch link 25 is limited in upward travel by a particular stop ring 27, as will be described hereinafter. Thimbles 18 serve to thrust balls 20 radially outward through holes 31 into contact with the inside surface of shaft 16, as shown in phantom in FIG. 2A. Radially outwardly held balls 20 engage shoulder 30 and thereby limit the upward travel of shaft 16. Thimbles 18 are positioned on coding rod 17 such that the upward travel of shaft 16 and therefor of knob 15 corresponds inversely to the upward travel of catch link 25 so that the length of upward travel of shaft 16 is proportional to the angular deviation of catch link 25 from the axis of sub 12.

Referring now to FIG. 2A, the upper portion of the apparatus of the preferred embodiment is illustrated. The apparatus is contained within a tubular housing 32 which is in several parts threaded together to aid in the assembly thereof. Main spring 29 is compressed between a shoulder 33 at the lower end of shaft 16 and a shoulder 34 at the top of a tubular member 35 contained within housing 32. Coding rod 17 terminates at the lower end thereof in a radially narrowed portion 36 inserted and connected by soldering or the like to a washer 37. Washer 37 is connected to a guide bushing 21 by means of a pair of snap rings 38 and 39. Guide bushing 21 is axially movable within coding tube 19 by means of pendulum lift spring 40, which is compressed between a radially enlarged portion 41 of guide bushing 21 and a lower collar 42 which is held against the lower end of coding tube 19 by means of snap ring 43. Pendulum lift spring 40 functions to move coding rod 17 axially upwardly and to lift guide bushing 21, which in turn lifts pendulum 24 by means of an actuator rod 22. Actuator rod 22 is coaxially mounted within guide bushing 21 and is restrained from moving axially therewithin by a shoulder 44 in guide bushing 21 that engages a radially enlarged portion 45 of actuator rod 22 and snap ring 38. The upward travel of guide bushing 21 is limited by a retaining ring 46 which engages coding tube 19.

At the lower end of actuator rod 22 is connected an orientor 23 which serves to orient the pendulum 24 with the low side of the hole during rotation of sub 12. Orientor 23 is freely rotatable upon actuator rod 22 by means of bearings 47 and 48. Bearings 47 and 48 are housed within a radially enlarged portion 49 of orientor 23 and are spaced apart by means of a spacer 50. Bearings 47 and 48 are retained on actuator rod 22 by means of a washer 51 and screw 52 threadedly engaged at the bottom of actuator rod 22 and a bearing clamp nut 53 threadedly engaged in the top of radially enlarged portion 49.

Orientor 23 includes a counter weight 54 that is radially asymmetrical with respect to the axis of actuator rod 22 and which hangs toward the low side of the hole and thereby orients the elements of the apparatus therebelow with the low side of the hole. During rotation of sub 12, counter weight 54 hangs toward the low side of the hole and thereby eliminates any wobble.

Figure 3:
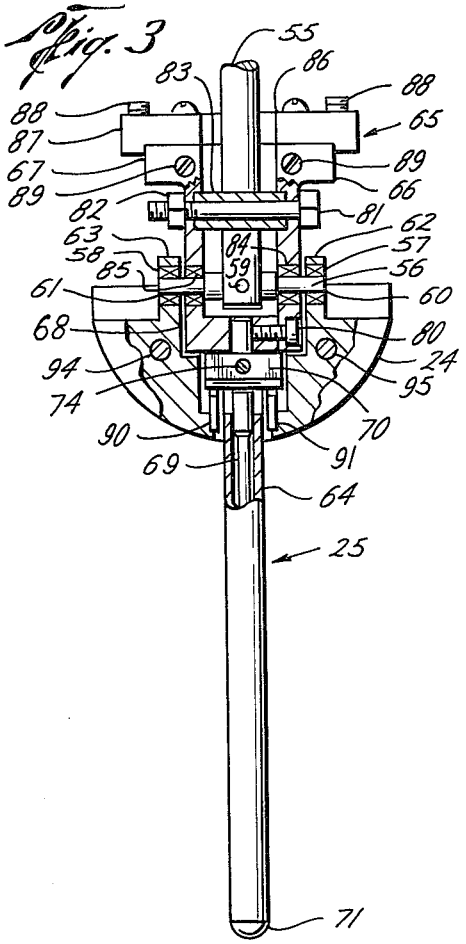
FIG. 3 is a partial side view of FIG. 2B showing details of the pendulum and catch link construction.

Referring now to FIGS. 2B and 3, the lower portion 55 of orientor 23 is pivotally connected to pendulum 24 by means of journal 56 mounted in a pair of bearings 57 and 58. Journal 56 is inserted through a hole through lower portion 55 and is held in place by means of a set screw 59. The ends 60 and 61 of journal 56 are radially narrowed to accommodate thereon bearings 57 and 58 respectively. Journal 56 is located in lower portion 55 of orientor 23 at right angles to counter weight 54 so that pendulum 24 hangs and seeks plumb toward the low side of the hole.

Also pivoted about journal 56, by means of a pair of bearings 84 and 85, is catch line 25. Catch link 25 includes a tubular lower member 64 and a counter weight, designated generally by the numeral 65. Catch link 25 extends through a void section 68 in the interior of pendulum 24.

Lower portion 64 of catch link 25 has telescopically disposed therewithin a plunger 59 having a pawl 70 attached to the upper end thereof and a button 71 at the lower end thereof. Plunger 69 is biased axially downwardly relative to outer portion 64 by means of a spring 72 compressed between button 71 and a shoulder 73 formed at the lower end of outer portion 64. Catch link 25 has, near the lower end of lower portion 64, a hook 76 for engaging stop rings 27 as will be described hereinafter.

While catch link 25 has an appearance generally similar to a pendulum of the prior art devices, catch link 25 is substantially perfectly balanced about journal 56 by means of counter weight 65 and has no gravity responsive characteristics. Counterweight 65 is comprised of two halves 66 and 67, which are connected together by a screw 80 and a bolt 81 and nut 82 spaced apart by spacer 83. Halves 66 and 67 include auxiliary weights 86 and 87 respectively which are attached by screws or the like.

It is contemplated that catch link 25 will be substantially perfectly balanced about journal 60 during the manufacture thereof; however, to correct any imbalance, adjustment screws 88 and 89 are provided. Adjustment screws 88 are tapped in auxiliary weights 86 and 87 and lie on a plane containing the axes of catch link 25 and journal 56 and movement thereof axially will correct any longitudinal imbalance about journal 56. Adjustment screws 89 are tapped normal to the axis of catch link 25 and movement thereof in and out will correct any imbalance caused by the axial asymmetry of catch link 25.

Since adjustment screws 88 and 89 are tapped normal to each other, adjustment screws 88 and 89 may be adjusted independently to substantially perfectly balance catch link 25 about journal 56. If upon manufacture and assembly of catch link 25 it is found that catch link 25 is not substantially balanced about the axis of journal 56, catch link 25 may be balanced by first orienting the longitudinal axis horizontally and moving adjustment screws 88 axially until catch link 25 has no tendency to rotate under the influence of gravity. When the longitudinal axis of catch link 25 is oriented horizontally, the position of adjustment screws 89 does not in any way cause any moment of torque. After adjustment screws 88 have been properly positioned, the orientation of catch link 25 is changed such that the longitudinal axis thereof is vertical and adjustment screws 89 are positioned such that catch link 25 again has no tendency to rotate under the influence of gravity. When the longitudinal axis of catch link 25 is vertically aligned, adjustment screws 88 have no tendency to produce a torque about journal 56. When adjustment screws 88 and 89 have been positioned as aforesaid, catch link 25 is substantially perfectly balanced about the axis of journal 56.

Pendulum 24 is of hemispherical construction and is adapted to swing through a large angle, which in the preferred embodiment is greater than 56 degrees. Pendulum 24 has a void 68 in the center thereof to accommodate catch link 25 and a pair of notch plates 90 and 91. The top portion of pendulum 24 that lies at the low side of the hole, is milled down to compensate for the weight removed by virtue of void 68. A pair of adjustment screws 94 and 95 are provided to balance pendulum 24 about the axis thereof so that the axis thereof will normally align with the vertical.

In other words, the pendulum axis may be considered to be an imaginary line which passes through both the pivot point and the center of gravity of the pendulum. When the pendulum is free-swinging and at rest in this illustrative embodiment, the axis will always be vertically oriented (within predetermined maximum limits) regardless of the angle of the axis of the drill string relative to vertical.

Figure 4:
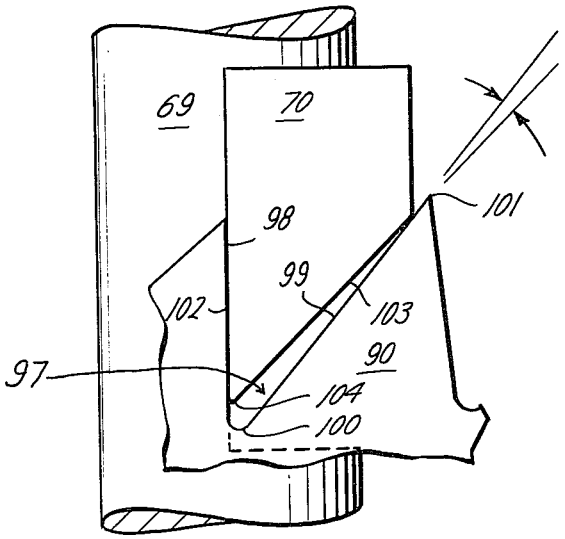
FIG. 4 is enlarged fragmentation view showing details of the notch plate and pawl.

Disposed within void 68 in pendulum 24 are a pair of arcuate serrated notch plates 90 and 91. Notch plates 90 and 91 have therein a plurality of generally upwardly facing V-shaped notches, each designated generally by the numeral 97. Each notch 97 includes a first side 98 which lies on a line intersecting the center of journal 56 and therefore the pivot point of pendulum 24, and a second side 99 which slants upwardly from the bottom 100 to the top 101 of each notch 97, as best seen in FIG. 4. The first side 98 of notches 97 form a plurality of surfaces, each of which may cause the pendulum axis to be deflected by catch link 25. The angular spacing between each adjacent side 98 of each notch 97 is equal, and in the preferred embodiment it is contemplated that such separation is 7 degrees. Each bottom 100 of each notch 97 lies along an arc having its center at the center of journal 56 and each top 101 of each notch 97 lies on a concentric inner arc.

Notch plate 90 and pawl 70 function to couple pendulum 24 and catch link 25 together so that angles much larger than heretofore measurable can be measured. Pawl 70 is attached to plunger 69 by means of a screw 74. Pawl 70 has an alignment side 102 which lies on the axis of plunger 69 and a biasing side 103. When the mud pumps are shut off and actuator rod 22 begins to move axially upward under the influence of pendulum lift spring 40, button 71 tends to remain biased into scat 110 by the action of spring 72. Plunger 69 and pawl 74 thus tend to remain stationary while pendulum 24 moves upwardly. As a result of this relative movement, biasing surface 103 will engage the top of one of the notches. The particular notch engaged will be selected as a result of (a) the angular orientation from vertical assumed by the axis of the plunger 69 which is coaxial with sub 12, and (b) the relative orientation of the axis of pendulum 24, which will always be vertical when the pendulum is free-swinging. Biasing surface 103 engages the tops 101 of the selected notch 97 and deflects pendulum 24 such that its axis is no longer vertical until alignment side 102 engages a first side 98 of the notch 97, at which point catch link 25 and pendulum 24 are coupled together.

Since catch link 25 is substantially perfectly balanced, the coupling thereof to pendulum 24 does not affect the plumb seeking properties of pendulum 24. Thus, when button 71 of catch link 25 is not restrained within seat 110, the axis of pendulum 24 returns to vertical and deflects catch link 25 away from the axis of sub 12.

The slope of the second side 99 of notch 97 is greater than that of biasing side 103 of pawl 70 so that the knife edge 104 does not contact anything and thus cannot become blunted or bent. It can be visualized by reference to FIG. 4 that if knife edge 104 were to contact side 99, knife edge 104 would tend to curl toward first side 98 and thereby introduce error into the system.

Adjacent to void 68 in pendulum 24 is a lower body sight hole, which is normally plugged by a plug 112. Single hole 111 provides means by which pawl 70 and notch plates 90 may be inspected without dissembling housing 32.

Below lower body sight hole 111 are a plurality of stop rings, designated generally by the numeral 27. Stop rings 27 form a plurality of concentric shoulders for engaging hook 76 of catch link 25, and are spaced axially apart such that when hook 76 engages one particular shoulder 113, one particular thimble 18 will be positioned within coding tube 19 such that appropriate coding balls 20 will be thrust into the path of shoulder 30 in shaft 16. The diameter of each stop ring 27 is such that the upward travel of hook 76 will be limited according to the angular deviation of catch link 25 from the axis of sub 12 and in the preferred embodiment the diameters are such that increments of one degree are measured.

In the preferred embodiment, since the angular separation between each notch 97 is 7 degrees, it is therefore necessary that stop rings 27 be configured to measure angles from 0 to 7 degrees. As is shown in FIG. 2B, six stop rings 27 are provided, whereby maximum deviation of catch link 25 is measured by the engagement of hook 76 with the shoulder designated 114 and minimum deviation is measured when hook 76 engages no stop rings 27; rather the axially upward travel of catch link 25 is limited by the engagement of the upper end of guide bushing 21 with retaining ring 46, illustrated in FIG. 2A.

Below stop rings 27 is catch link seating ramp assembly 118, as best seen in FIG. 2B. Seating ramp assembly 118 includes an upper portion 119, which abutts stop rings 27 and a lower frustrum shaped lower portion 120. Seating ramp assembly 118 has therein a pair of holes 121 and 122 and ports 123 and 124. Holes 121 and 122 and ports 123 and 124 allow for the flow of fluid 154 with which apparatus 11 is filled. Fluid 154 conveniently takes the form of commercially available 300 centistoke silicone fluid, and serves to lubricate the various moving parts of the apparatus, damp oscillation of pendulum 24 and catch link 25, and slow somewhat the movement of the parts upwardly and downwardly. It has been found that the reliability of the apparatus is greatly enhanced by the addition of approximately 0.25% by weight of dioleyl hydrogen phosphite to the fluid 154.

Lower portion 120 of seating ramp 119 serves to guide button 71 of catch link 25 into seat 110 as pendulum 24 and catch link 25 move downwardly under the influence of mud pressure on knob 15. Seat 110 has an initial frustrum shaped portion 125, which has a slope substantially equal to that of lower portion 120 of seating ramp 119, and a lower cylindrical portion 126. Portion 126 has an inside diameter substantially equal to the diameter of button 71 and functions to restrain catch link 25 in axial alignment with sub 12 as pawl 70 engages one of the notches 97. Seat 110 also serves to restrain button 71 from further axially downward movement to thereby disengage pawl 70 from notch 97 when knob 15 is again pushed down by the drilling mud. This allows pendulum 24 to return to plumb.

Below seating ramp 118 is a cylindrical restricter block 131 that accommodates various fluid control means, including a check valve 132, orifice discs 133 and a relief valve (not shown). Orifice discs 133 serve to inhibit the downward flow of fluid 154 through apparatus 11, thereby slowing the downward movement of knob 15 past pulse rings 114 to space apart the pressure pulses generated thereby. Check valve 132 closes against downward the flow of fluid 154 and opens to upward fluid flow to allow the parts of the apparatus to travel upwardly more easily under the influence of main spring 29 and pendulum lift spring 40. The relief valve (not shown) serves to protect the instrument against damage from excessive pressure within housing 32. Restricter block 131, seating ramp assembly 118, and stop rings 27 are retained in the lower portion of housing 32 by means of a snap ring 135.

Fluid 154 displaced within housing 32 by the movement of the various parts is accommodated by an axially moveable piston 137 located below snap ring 135. Piston 137 sealingly engages the inside of housing 32 by means of a quad-ring 138. Piston 137 has a pair of radial ports 139 and 140 therein for the flow of fluid 154 into a cylindrical chamber 141 therein. The fluid within chamber 141 serves to lubricate bearings 127 and 128 which mount seat 110. The lower portion of chamber 141 is sealed by a plug 142, which is held in place by means of a snap ring 143. The lower portion of piston 137 is threaded to provided means by which a threaded tool can be engaged to remove piston 137 from housing 32 for inspection and servicing.

Threadedly engaged in the center of restricter block 131 is a restricter block insert 145. Restricter block insert 145 has a cylindrical lower portion 146 that extends into chamber 141, and an upper threaded portion, which contains seat bearing assembly 147. Seat bearing assembly 147 contains therein bearings 127 and 128 and spacer 129, which contain seat 110. Bearing 128 is retained at the bottom of seat 110 by a screw and washer 151. Seat 110 is thus rotatable relative to sub 12 so that the rotation of sub 12 will not impart any rotation to catch link 25.

Figures 5, 6, 7:
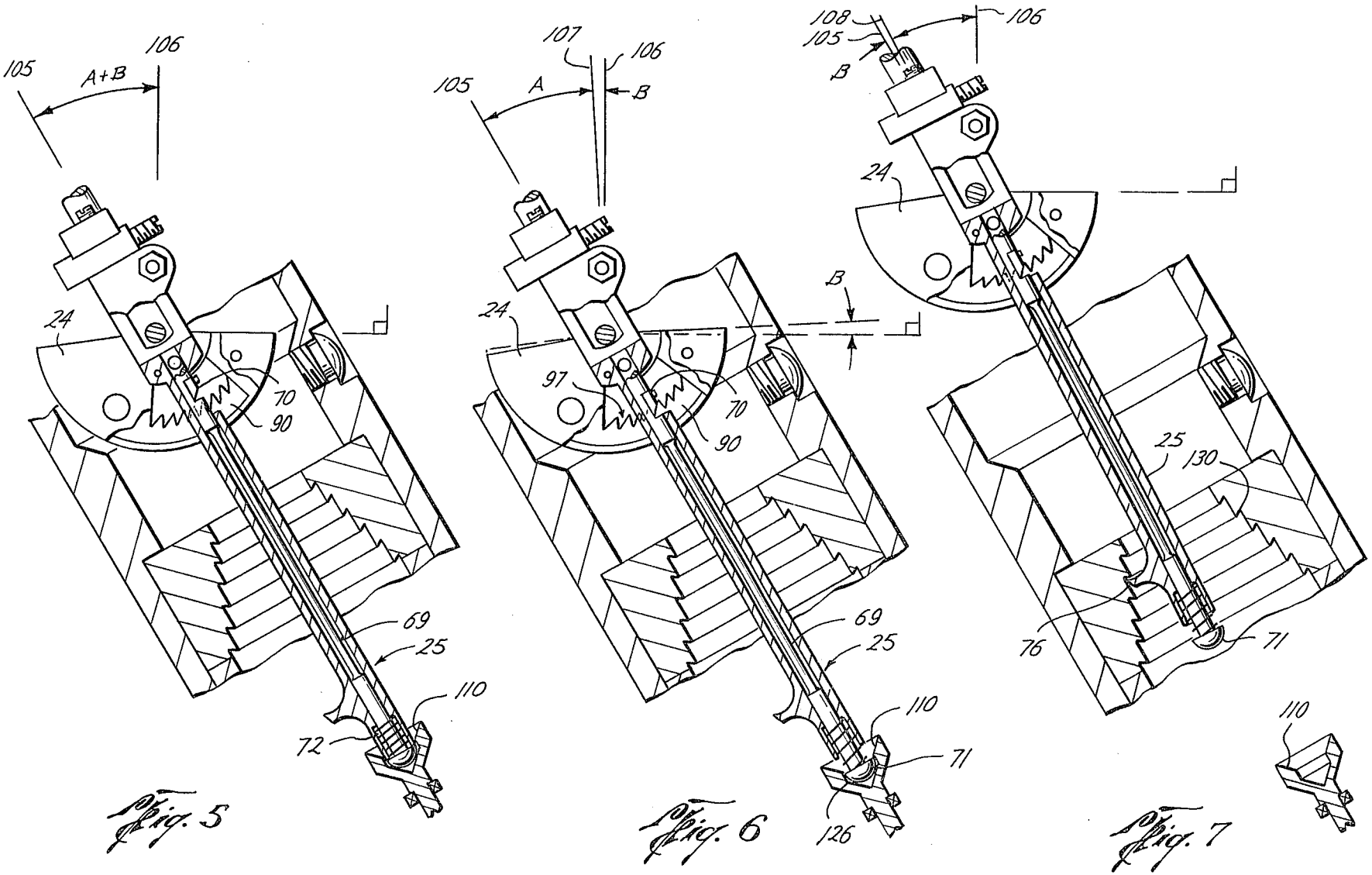
FIGS. 5–7 form a time sequence of sectional views showing the operation of the apparatus of the preferred embodiment.

The operation and geometry of the apparatus of the present invention may best be understood by reference to FIGS. 5–7 wherein is illustrated a situation where the angular drift from the vertical of the string is equal to an angle A plus B: where A is a known angle equal to the angular separation of notches 79 times the number of the notch engaged minus one, and B is an unknown angle to be measured. Since in the preferred embodiment of the invention the angular separation of notches 97 is 7 degrees, and pawl 70 is shown in FIGS. 5–7 in a position to engage the fifth notch 97, angle A is equal to 28 degrees.

Throughout FIGS. 5–7, the line designated by the numeral 105 represents the axis of sub 12, and therefore the axis of the end of the string, and the line designated by the numeral 106 designates the vertical. FIG. 5 illustrates the situation where the mud pumps are in operation and catch link 25 is fully seated within seat 110 and substantially coaxial with axis 105 of sub 12. Spring 72 is fully compressed and pawl 70 is disengaged from notch plate 90. Pendulum 24 is thus free to swing and the axis thereof is aligned with the vertical 106. Therefore, the angular separation between the axes of pendulum 24 and catch link 25 is equal to the angular drift from the vertical of the end of the string, or A plus B.

FIG. 6 illustrates the situation a short time after the mud pumps have been deactuated wherein pendulum 24 is shown lifted slightly under the influence of pendulum lift spring 40; however, button 71 of plunger 69 is still biased into lower cylindrical portion 126 of seat 110 and pawl 70 has engaged the fifth notch 97. Catch link 25 is still coaxial with axis 105 of sub 12; however, the axis of pendulum 24, has been deflected B degrees from the vertical 106 to a portion 107 by the interaction of pawl 70 with notch 97. Pendulum 24 and catch link 25 are thus coupled together such that the axes thereof are A degrees apart.

FIG. 7 illustrates a still further point in time when button 71 has become disengaged from seat 110. With catch link 25 no longer restrained to remain coaxial with axis 105 of sub 12, the axis of pendulum 24 returns to the vertical 106 and the axis of catch link 25, now designated by numeral 108, is deflected B degrees from the axis 105 of sub 12. Since the catch link is fully balanced, it holds itself in a position fixed to the pendulum such that the pendulum axis is vertical. The upward travel of pendulum 24 is limited by the engagement of hook 76 with a stop ring designated by the numeral 130 and, through coding system 151 knob 15 moves axially upwardly to a position adjacent the pulse ring 14 designated by the numeral 134 in FIG. 1. Upon resumption of the flow of mud 153, the driller would detect three pressure pulses and would thus know that angle B is equal to 2 degrees. The driller would then determine that the angular drift of the end of the string is equal to 30 degrees, i.e., the known angle of 28° plus 2°. Also upon resumption of the flow of mud 53 pendulum 24 would be driven axially downwardly and the apparatus would return to the configuration illustrated in FIG. 5 whereupon the drift of the end of the string may again be measured upon subsequent interruption of the flow of mud 153. If, during subsequent drilling, the drift remains constant at the illustrative angle of 30 degrees, then at each interruption in drilling, the driller will detect three pulses. If, however, the drift were to increase to, for example, 31 degrees, the driller would detect four pulses. Similarly, if the drift were to decrease to, for example, 29 degrees, the driller would detect two pulses.

It becomes apparent that in the preferred embodiment of the present invention the driller will always detect from one to seven pulses, which will indicate angles from 0 to 6 degrees within each 7 degree range formed by notches 97. For example, one pressure pulse detected by the driller could indicate that the angular drift of the end of the string is equal to 0 degrees. However, one pressure pulse could also indicate that the angular drift of the end of the string is equal to 7 degrees or 14 degrees or some other multiple of 7 degrees. Similarly, four pressure pulses detected by the driller could indicate that the angular drift of the end of the drill string is equal to 3 degrees from the vertical; however, four pulses also could indicate a drift of 10 degrees or 17 degrees or some other angle equal to a multiple of 7 degrees plus 3 degrees. It is therefore necessary that the driller know initially the angular deviation of the end of the string and then keep a continuous record of subsequent measurements.

For example, the apparatus of the present invention could be inserted in the string when drilling is first commenced and the drift from the vertical of the string is substantially 0. Upon each interruption of the flow of mud 153, a reading may be taken and recorded. As the angular drift of the end of the string increases, the number of pulses would increase until the drift angle became larger than 7 degrees, at which point the number of pulses would drop from 7 to 1. Because of the nature of the environment and the equipment used, there is virtually no possibility of an ambiguous reading being detected. By keeping continuous record of the readings taken, the deviation of the hole may be mapped. In an alternative method, the initial measure of drift of an already started hole may be obtained by measuring the drift angle of the bottom of the hole with conventional measuring means and then commencing measuring of the drift angle with the apparatus of the present invention.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the form of the invention herewith shown and described is to be taken as the presently preferred embodiment. Various changes may be made in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description.

What is claimed is:

1. In apparatus for measuring the angular deviation from a preselected drift angle of the end of a drill string, the combination comprising:

a housing adapted for insertion in said drill string;

a pendulum pivotally mounted in said housing and having an axis, said axis being normally aligned with the vertical under the influence of gravity;

a cylindrical catch link pivotally mounted at the same point as said pendulum, said catch link being substantially balanced about said pivot point;

means for aligning the longitudinal axis of said catch link substantially parallel with the axis of said drill string;

means for coupling together said pendulum and catch link such that the angle between said axes of said catch link and pendulum substantially equal said preselected angle;

means for measuring the angular deflection from the vertical of said axis of said pendulum coupled to said catch link, to thereby measure the difference between said angular deviation of said drill string and said preselected angle;

and means for signaling to the surface the measure of said angular deflection from the vertical of said axis of said pendulum.

2. The apparatus as claimed in claim 1, wherein:

said means for aligning said catch link includes a frustrum-shaped seat coaxially disposed within said housing.

3. The apparatus as claimed in claim 1, wherein said coupling means includes:

a notch disposed within said pendulum;

a pawl connected to said catch link;

and means for engaging said pawl in said notch.

4. The apparatus as claimed in claim 3, wherein:

said catch link includes a tubular outer member and a cylindrical plunger telescopically movably disposed within said outer member, wherein said plunger has connected thereto said pawl;

and said engaging means includes means for biasing said plunger telescopically relative to said outer member to engage said pawl with said notch.

5. The apparatus as claimed in claim 3, wherein:

said notch includes a first side which lies on a line intersecting said axis of said pendulum at said preselected angle and a second side which slopes upwardly away from said first side;

and said pawl includes a side lying on the axis of said catch link.

6. The apparatus as claimed in claim 1, including means for orienting said axis of said pendulum with the vertical substantially continuously during the rotation of said drill string.

7. In apparatus for measuring the angular deviation from a plurality of preselected drift angles of the end of a drill string, the combination comprising:

a housing adapted for insertion coaxially in said drill string;

a pendulum pivotally mounted at a point on the axis of said housing, wherein said pendulum is free to swing about said pivot point when mud is pumped through said string, and said pendulum has an axis, said axis being normally aligned with the vertical under the influence of gravity;

a cylindrical catch link pivoted at the pivot point of said pendulum;

means for aligning said catch link coaxially with said string when mud is pumped therethrough;

means for coupling together said pendulum and catch link at one angle of said plurality of preselected drift angles to deflect the axis of said pendulum away from the vertical;

means for measuring the deflection from the vertical of said axis of said pendulum, to measure the difference between said angular deviation and said one angle of said preselected angles;

and means for signaling to the surface the measure of said deflection.

8. The apparatus as claimed in claim 7, wherein said coupling means includes:

an arcuate serrated notch plate disposed within said pendulum and having a plurality of V-shaped notches therein, wherein each of said notches has a bottom which lies upon an outer arc, the center of which arc is at said pivot, a top which lies upon an inner arc within and concentric with said outer arc, a first side which lies on a line intersecting said axis of said pendulum at said pivot point, and a side which slants upwardly from said bottom to top of said notch, wherein each of said first sides of said notches lies on one of said preselected angles;

a pawl axially movably connected to said catch link, and engagable with said notches;

and means for engaging said pawl with one of said notches, to thereby couple together said pendulum and catch link at one angle of said preselected angles.

9. The apparatus as claimed in claim 7, wherein:

said catch link includes a tubular outer member and a plunger telescopically movably disposed within said outer member, wherein said plunger has attached thereto said pawl;

and means for moving said plunger telescopically relative to said outer member to engage said pawl with said notch.

10. In apparatus for measuring the angular deviation of the end of a drill string, the combination comprising:

a tubular housing adapted for insertion coaxially in said string;

a shaft extending axially outwardly from and axially movable relative to said housing, said shaft having a knob at the upper end thereof;

means for forming pressure pulses in the mud stream in response to the axial position of said knob;

a rod coaxial with and axially movable within said housing;

means for urging said rod axially upwardly within said housing;

a pendulum pivotally mounted at substantially the end of said rod and having an axis with generally vertical alignment;

an arcuate serrated notch plate disposed within said pendulum and having a first V-shaped notch therein, said first notch having a first side which lies along said axis of said pendulum, and a plurality of other V-shaped notches spaced at equal angles along said notch plate, each having a first side which lies on a line intersecting the point at which said pendulum is suspended;

a tubular catch link pivoted at and balanced about said pivot point of said pendulum;

a plunger telescopically movably disposed within said catch link;

a pawl attached to the upper end of said plunger and disposed above said notch plate and having a side which lies on the axis of said catch link;

means for urging said plunger axially downwardly as said catch link moves axially upwardly, whereby said pawl engages one of said notches to couple together said pendulum and catch link at a known angle and deflects said pendulum from the vertical;

means responsive to the deflection of said pendulum for limiting the upward travel of said catch link to thereby limit the upward travel of said rod;

and means for translating the axially upward travel of said rod into inversely corresponding axially upward travel of said shaft, whereby the deflection from the vertical of said pendulum may be of said shaft, whereby the deflection from the vertical of said pendulum may be measured by the number of pulses generated by said pulse forming means to thereby determine the difference between said deviation of said string and said known angle.

11. In apparatus for measuring the deviation from the vertical of the longitudinal axis of a drill string, the combination comprising:

a housing adapted for insertion into a drill string;

a pendulum pivotally mounted in said housing so as to normally be free-swinging therein and having a pendulum axis passing through its center of gravity and its pivotal mounting point which is vertically oriented when said pendulum is free-swinging;

means for deflecting the pendulum axis away from the vertical orientation until said pendulum axis is angularly separated from the axis of the drill string by a known angle;

means for measuring the angle to which said pendulum axis has been deflected; and means for generating a signal indicative of the measured angle of the pendulum axis deflection.

12. The apparatus as claimed in claim 11, wherein said deflecting means includes:

a cylindrical catch link pivotally mounted in said housing at said pivotal mounting point of said pendulum;

means for restraining said catch link such that the axis of said catch link is aligned with said longitudinal axis of said string during drilling;

and means for coupling said pendulum and said catch link together at said known angle.

13. The apparatus as claimed in claim 12, wherein said measuring means includes:

means for releasing said catch link from said restraining means while said catch link is coupled to said pendulum, whereby said pendulum axis returns to the vertical orientation thereby deflecting said axis of said catch link away from said axis of said string by an angle equal to the deflection of said pendulum axis;

and means for measuring the deflection of said catch link from said axis of said string.

14. Apparatus for measuring the deviation of the longitudinal axis of a drill string below the surface of the earth, from a known angle of deviation from vertical, including a housing adapted for insertion into a drill string, an angularly movable pendulum mounted in said housing, and means operatively connected to said housing for signaling the amount of angular movement of said pendulum to the drilling surface, characterized in that said pendulum is mounted for movement about a pivot axis so as to be free-swinging within said housing, at least just at the moment that drilling is stopped, such that an axis passing through the pivot axis and the center of gravity of the pendulum is vertically aligned at the instant when drilling is stopped and said pendulum is free-swinging; and means are operatively connected to said pendulum after drilling is stopped for deflecting said pendulum axis a number of degrees equal to the deviation of the drill string axis from said known angle of deviation from the vertical.

* * * * *

UNITED STATES PATENT AND TRADEMARK OFFICE

CERTIFICATE OF CORRECTION

PATENT NO. : 4,216,590

DATED : August 12, 1980

INVENTOR(S) : Robert R. Kelly

It is certified that error appears in the above-identified patent and that said Letters Patent are hereby corrected as shown below:

Column 2, line 21, delete "collected" and insert —deflected—; column 3, page 30, delete "therefor" and insert —therefore—; column 5, line 49, insert "adjacent" between the words "of each" and the words "notch 97"; column 5, line 63, delete "scat" and insert —seat—; column 6, line 25, delete "single" and insert —sight—; column 6, line 26, delete "dissembling" and insert —disassembling—; column 6, line 56, delete "abutts" and insert —abuts—; column 7, line 26, delete "the"; column 7, line 46, delete "provided" and insert —provide—; column 8, line 24, delete "," following the numeral "24"; column 8, line 25, delete "portion" and insert —position—; column 8, line 48, delete "mud 53" and insert —mud 153—; column 11, line 5, delete "engagable" and insert —engageable—; column 11, line 60, delete "said pendulum may be of said"; column 11, line 61, delete "shaft, whereby the deflection from the vertical of".

Signed and Sealed this

*Eighteenth* Day of *November 1980*

[SEAL]

*Attest:*

SIDNEY A. DIAMOND

*Attesting Officer*

*Commissioner of Patents and Trademarks*